United States Patent [19]

Hamada et al.

[11] Patent Number: 4,597,278

[45] Date of Patent: Jul. 1, 1986

[54] METHOD FOR PRODUCING I-BEAM HAVING CENTRALLY CORRUGATED WEB

[75] Inventors: Masami Hamada; Kiyokazu Tanaka; Takeshi Kikuchi, all of Ibaraki; Yasuhiro Asai, Chiba; Chihiro Hayashi, Hyogo; Fumio Ohtake, Chiba, all of Japan

[73] Assignee: Sumitomo Metal Industries, Ltd., Japan

[21] Appl. No.: 751,433

[22] Filed: Jul. 3, 1985

Related U.S. Application Data

[63] Continuation-in-part of Ser. No. 468,281, Feb. 22, 1983, abandoned, which is a continuation-in-part of Ser. No. 178,634, Aug. 15, 1980, abandoned.

[30] Foreign Application Priority Data

| | | | |
|---|---|---|---|
| Aug. 24, 1979 | [JP] | Japan | 54-107778 |
| May 9, 1980 | [JP] | Japan | 55-61533 |
| May 20, 1980 | [JP] | Japan | 55-69414 |

[51] Int. Cl.[4] ..... B21D 13/04

[52] U.S. Cl. ..... 72/187; 52/729; 72/196

[58] Field of Search ..... 72/187, 196, 197, 198, 72/366; 52/729

[56] References Cited

U.S. PATENT DOCUMENTS

| | | | |
|---|---|---|---|
| 1,302,497 | 5/1919 | Barbour | 72/366 |
| 1,464,018 | 8/1923 | Trachte et al. | 72/196 |
| 1,632,793 | 6/1927 | Henderson | 72/198 |
| 1,937,466 | 11/1933 | Smith et al. | 72/187 |
| 2,684,707 | 7/1954 | Getz | 72/187 |
| 3,163,925 | 1/1965 | Ulm | 29/159.2 |
| 4,251,973 | 2/1981 | Paik | 52/729 |

FOREIGN PATENT DOCUMENTS

| | | | |
|---|---|---|---|
| 46414 | 4/1889 | Fed. Rep. of Germany | 52/729 |
| 2289265 | 5/1976 | France | 72/196 |
| 241247 | 9/1964 | Japan . | |
| 25250 | 10/1970 | Japan . | |

*Primary Examiner*—Lowell A. Larson

*Attorney, Agent, or Firm*—Burns, Doane, Swecker & Mathis

[57] ABSTRACT

An I-beam is made lighter in weight by corrugating the central portion of its web. Dimension of the corrugating is determined by predetermined experimental equations. The corrugating work is performed by a pair of complementary intermeshing rolls having the same dimensions.

1 Claim, 32 Drawing Figures

Fig. 18C
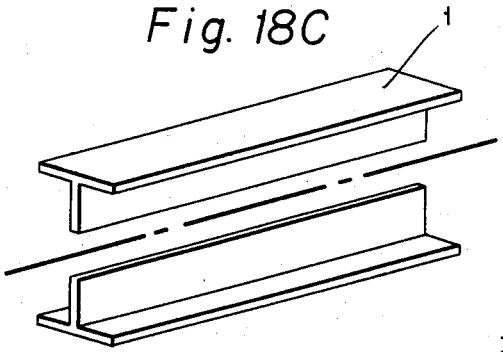
divided I-beam
Fig. 19C
torsion
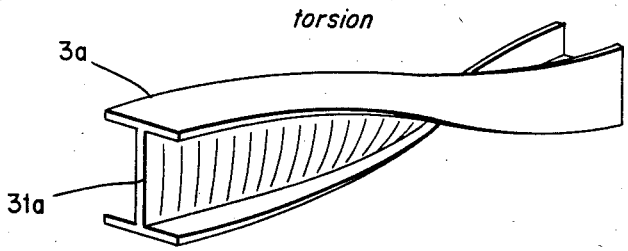
Fig. 19D
convex deformation
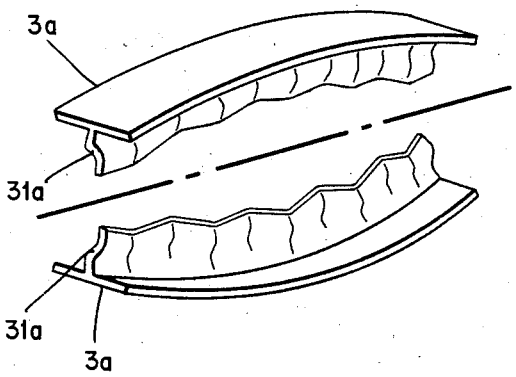
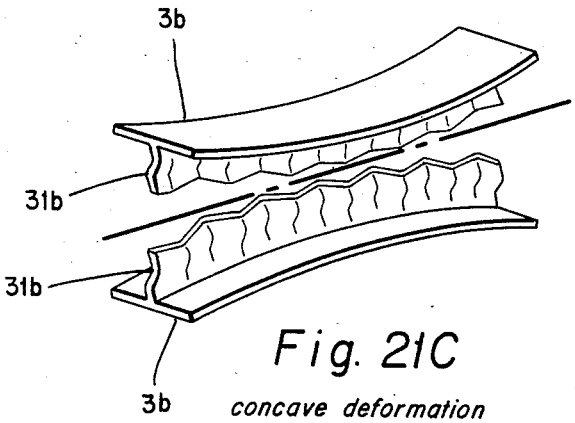
Fig. 21C
concave deformation

METHOD FOR PRODUCING I-BEAM HAVING CENTRALLY CORRUGATED WEB

This application is a continuation-in-part application of U.S. application Ser. No. 468,281, filed Feb. 22, 1983, which application in turn is a continuation-in-part application of Ser. No. 178,634, filed Aug. 15, 1980, both now abandoned.

BACKGROUND OF THE INVENTION

The present invention relates to a method for producing an I-beam having a centrally corrugated web.

The web of an I-beam has less effect than the flange on the section modulus of the I-beam as a bending structural member. In producing the I-beam, accordingly, the web is made as thin as possible for economy in the use of material. As the demand for lighter steel members has become greater in recent years, the web of the I-beam has been made thinner and thinner. However, there is a limit to the thinness of the web from the viewpoint of shearing buckling strength of the web. It is known that theoretically the web of an I-beam can be made thinner than the generally accepted practical limit by corrugating the web. As a matter of fact, however, an I-beam having a corrugated web has not yet been put on the market as an industrial product since the corrugating of the web of the I-beam is very difficult.

OBJECTS AND SUMMARY OF THE INVENTION

Accordingly, an object of the present invention is to provide a method for producing an I-beam having a corrugated web economically and efficiently.

A further object of the present invention is to provide a form and dimensions of corrugation having an increased effect on both the shearing buckling strength and web lateral compression strength of the I-beam within the current producing technology.

In accordance with the present invention, there is provided a method for producing an I-beam having a centrally corrugated web, comprising the steps of:

corrugating a central portion of the web of a finished ordinary I-beam by passing between first and second pairs of complementary intermeshing corrugating rolls in a single pass a finished ordinary I-beam having an uncorrugated web with a thickness t and a web height h for producing in said web by the action of said corrugating rolls thereon corrugations having a width C and an amplitude f and said corrugations being at a pitch L, in the following relationships:

$9.3t<L<36t$ $1.0t<f<3.9t$ $0.5h<C<h-L$, said amplitude f being uniform from substantially one side of said width C to the other;

reducing the thickness of the web by the action of said intermeshing corrugating rolls for increasing the developed lengths $S_1$ and $S_2$ of the web portions corrugated by said first and second pairs of rolls as compared to the rectilinear length $S_0$ of the flat web before corrugation, respectively, while making no other change in the major dimensions of the I-beam, in the following relationships:

$$\epsilon_1=(S_1-S_0)/S_0$$

$$\epsilon_2=(S_2-S_1)/S_1$$

$$\epsilon=(S_2-S_0)/S_0$$

$$\epsilon=\epsilon_1+\epsilon_2$$

$$\epsilon_1/\epsilon=0.2 \text{ to } 0.8; \text{ and}$$

forming the convex portions of the corrugations worked by said first pair of rolls into the concave portions of the corrugations by said second pair of rolls for improving the residual stress conditions and reducing or eliminating cambering and torsion of the thus corrugated beam.

The producing method according to the present invention is characterized in that corrugating is performed on the central area of the web of the I-beam by a pair of complementarily intermeshing rolls in such a way that there will be no change in the principal dimension of the I-beam except for web thickness. During the method of the present invention, the convex portions of the corrugations formed by the first pair of rolls are worked by the second pair of rolls into concave portions of the finished corrugations (and vice versa). This type of working produces a corrugated web which has improved residual stress conditions and reduced tendency to camber and/or torsion.

The producing rolls for use in the method according to the present invention are characterized in that each has in the roll working surface a pair of grooves for guiding the flanges of the I-beam and a corrugated zone between said grooves and that a pair of said rolls are complementarily intermeshed in the corrugated zones.

Taking note of the fact that it is not always necessary for the rolls to constrainedly guide both the sides of the flanges of the I-beam and that it is necessary only to guide one side of each of the flanges for centering of the I-beam, the producing rolls used in the method of the present invention have a construction obviating the need for forming grooves in each of the rolls and having the distance between the grooves adjusted to the flange width.

BRIEF DESCRIPTION OF THE DRAWINGS

The invention will be better understood from the following description taken in connection with the accompanying drawings, in which:

FIGS. 18A, 18B and 18C are schematics of a longitudinal cross-section through an I-beam, the residual stress distribution in the web of the I-beam and the effects of the stress in the I-beam divided longitudinally through the web, respectively;

FIGS. 19A, 19B, 19C and 19D are schematics of a longitudinal cross-section through the web 31*a* of the I-beam of FIG. 1, the residual stress distribution in the corrugated web of that I-beam, the effect of the stress in the I-beam undivided and divided longitudinally through the web, respectively;

FIGS. 21A, 21B and 21C are schematics of a longitudinal cross-section through the web 31*b* of the I-beam of FIG. 1, the residual stress distribution in the corrugated web of that I-beam and the effect of the stress in the I-beam divided longitudinally through the web, respectively;

DESCRIPTION OF THE PREFERRED EMBODIMENTS

Figure 1A:
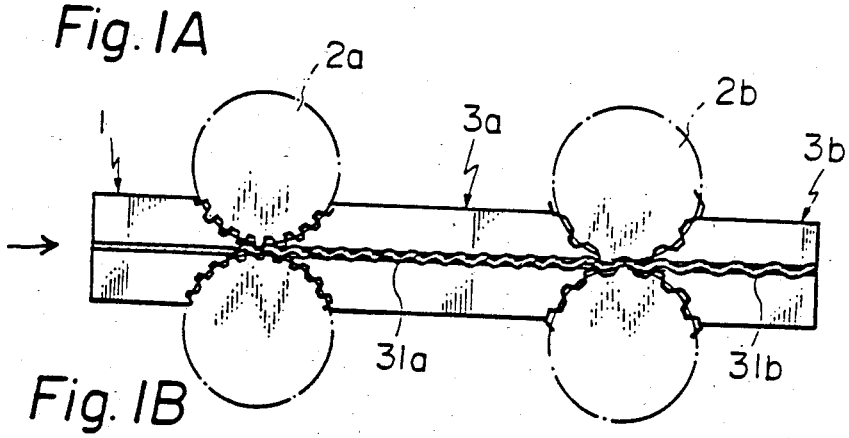
FIGS. 1A and 1B are schematic illustrations of a production line for carrying out the method according to the present invention and the resulting corrugated I-beam, respectively.

The method according to the present invention will now be described with reference to the drawings. In the production line for carrying out the method according to the present invention as schematically illustrated in FIG. 1A, an ordinary I-beam 1 is corrugated by producing rolls 2*a* and 2*b* according to the present invention into a worked I-beam 3*b* having a corrugated web.

The ordinary I-beam may be a hot-rolled or welded I-beam. The corrugating by the producing rolls 2*a* and 2*b* may be either cold or hot working. The producing rolls 2*a* and 2*b* will be described in fuller detail with reference to FIGS. 9 to 17.

The I-beam 3 (FIG. 2) worked by the method according to the present invention is not corrugated for the full width of its web 31 but only in the central portion of the web 31. Since a flat portion 311 is left intact at each of edges of the web, the corrugating can be performed easily without having any adverse effect upon the junction between the web 31 and flanges 32 of the I-beam 3.

While a theoretical analysis of various factors such as the forces required for the corrugating in the method according to the present invention is difficult, repeated experiments show that the closest approximation is not a theoretical equation for deep drawing but a theoretical equation for cold rolling combined with a theoretical equation for U-bending. The closest approximate theoretical equations are as follows:

$$P = P_1 + P_2$$

$$P_1 = 2\sigma \cdot C\sqrt{R\Delta t}$$

$$P_2 = 2C \cdot t \cdot \sigma(1 + t/L) + 2C \cdot t^2 \cdot \sigma/L$$

where,

P: rolling load $P_1$:cold rolling load $P_2$: U-bending load $\sigma$: tensile strength C: width of corrugation t: thickness of web L: pitch of corrugation $\Delta t$: reduction in web thickness The depth of wave $\delta$ (see FIG. 4) of the corrugation of the web is, assuming that the increased length of the web produced by the rolling forms the wave, expressed by the following equation which has been confirmed to be correct by experiments:

$$\delta = 2L \cdot \frac{1}{1-\phi} \cdot \frac{1}{\sqrt{6\phi}} (1 - \cos\sqrt{6\phi})$$

where, $\phi$: reduction rate

Figure 1B:
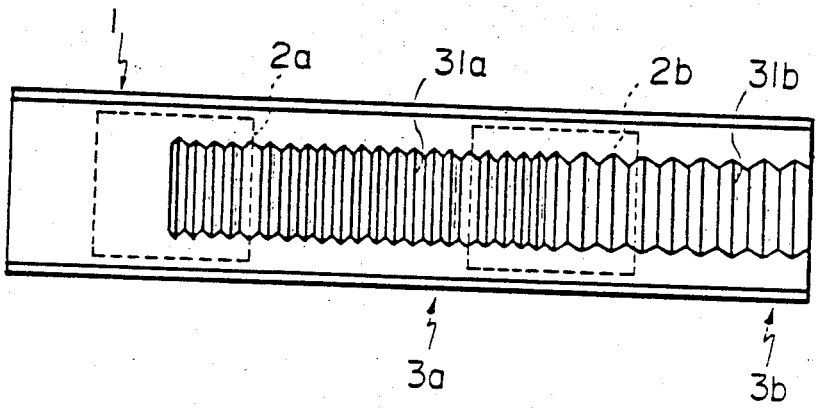

While a pass through a single pair of complementary intermeshing rolls is sufficient for corrugating the web of the I-beam, passing the I-beam (on a single pass) through two or more sets of complementary intermeshing rolls as in the present invention (described in more detail hereinbelow) is preferable for a product free from cambering or torsion because the shape of the corrugation changes in the second or later pass redistributes and reduces the residual stress to a desirable condition. As shown in FIGS. 1A and 1B, an ordinary I-beam 1 is passed through a first pair of complementary intermeshing rolls 2*a* to form a first worked I-beam 3*a* having a first corrugated web 31*a*. Then the I-beam 3*a* is passed through a second pair of complementary intermeshing rolls 2*b* to form a second worked I-beam 3*b* having a second corrugated web 31*b* which has the finished shape and dimensions of the corrugations. First rolls 2*a* and second rolls 2*b* preferably have the same dimensions and shape (including diameter, width, amplitude and shape of the corrugations). In this fashion, the number of spare rolls can be decreased and there is an increased ease in the driving of the rolls.

In the method of this invention, first rolls 2*a* produces a corrugated web 31*a* which has an amplitude and web thickness which are from 20 to 80% of that produced by second rolls 2*b*. In addition, the direction of the corrugations produced by the first rolls 2*a* is reversed by second rolls 2*b*. That is, the convex corrugations produced by first rolls 2*a* are formed by second rolls 2*b* into concave corrugations.

First and second rolls 2a and 2b can be arranged in conventional manner to accomplish these changes. For example, the roll gap between the complementary pair of rolls 2a can be varied and controlled (e.g., by sensing the roll reaction force on one of the rolls) to produce the desired corrugations 31a in the I-beam while the reversal of the amplitude can be effected by adjusting the distance between the axes of the first and second pairs of rolls 2a and 2b.

Figure 18A:
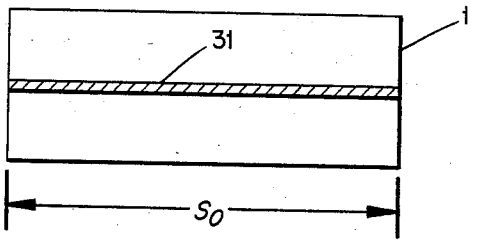
Figure 18B:
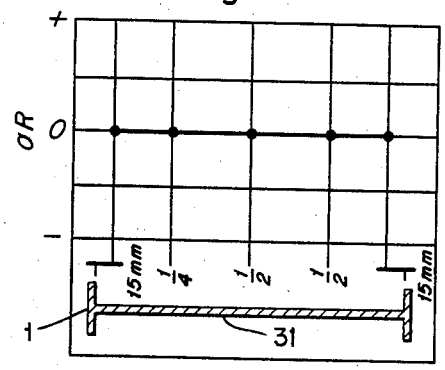

FIG. 18A represents the longitudinal cross-section through an ordinary finished I-beam 1 having a length $S_0$ before a portion of the web is corrugated. FIG. 18B represents the residual stress value across the transverse cross-section of the web of that I-beam. The stress across the web 31 of the I-beam 1 is essentially zero throughout its width and if the I-beam 1 was divided at the midpoint of the web 31, the divided I-beam would not show any deformation (FIG. 18C).

Figure 19A:
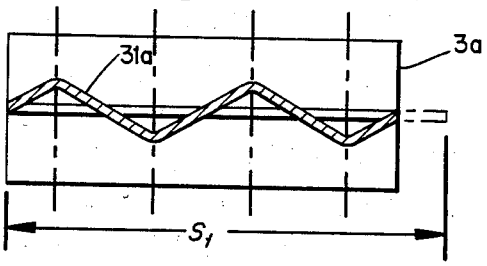
Figure 19B:
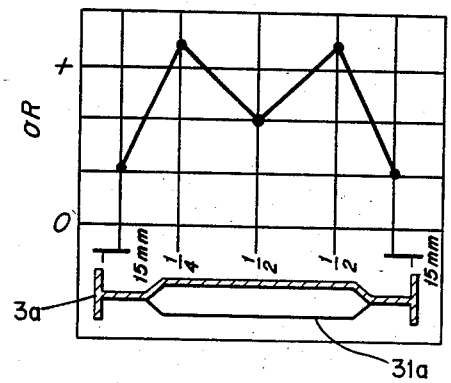

FIG. 19A represents web 31a which (as shown in FIG. 1) is the product of the action of the first set of rolls 2a on the web of the I-beam 1. The web 31a contains developed corrugations and the I-beam now has a length $S_1$ which represents the developed length of the first corrugated web 31a of the I-beam after working by the first pair of rolls 2a. FIG. 19B represents the residual stress values across the web 31a.

As shown in FIG. 19B, I-beam 3a has unbalanced residual stresses ($+\sigma$) in web 31a. Consequently, a torsion is caused in I-beam 3a (FIG. 19C) and convex deformation is caused in the divided I-beams produced by dividing I-beam 31a along the midpoint of the web (FIG. 19D).

Figure 20A:
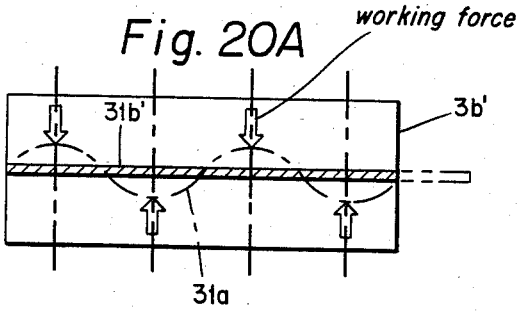
FIGS. 20A and 20B are schematics of a longitudinal cross-section through the web of a transitional shape of the I-beam of FIG. 1 and the residual stress distribution in the web of that I-beam.
Figure 20B:
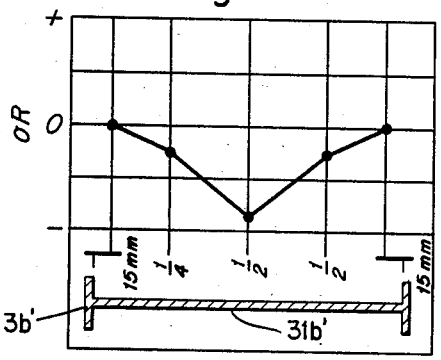
Figure 21A:
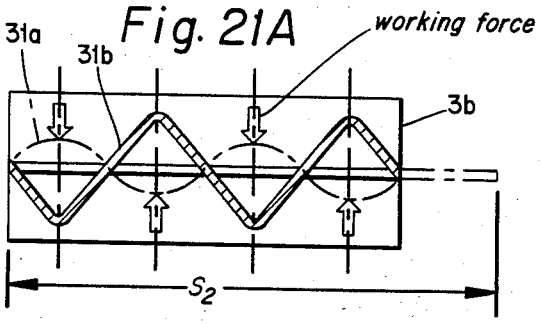
Figure 21B:
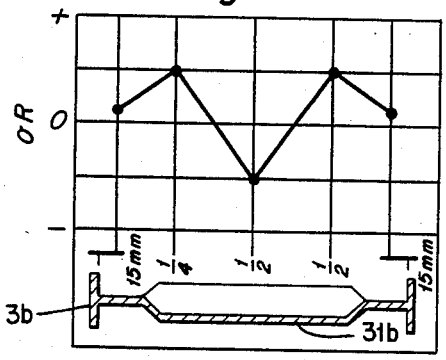

FIG. 20A illustrates the transition shape of second I-beam 3b' while FIG. 21A illustrates the final shape of second I-beam 3b having the developed length of the second corrugated web 31b of the I-beam worked by the second pair of rolls 2b. Although transitional I-beam 3b' has unbalanced residual stresses ($-\sigma$ in FIG. 20B) in web 31b', second I-beam 3b has balanced residual stresses ($+\sigma$ to $-\sigma$ in FIG. 21B) in web 31b. Consequently, no torsion is caused in second I-beam 3b and concave deformation is caused in the divided I-beams produced by dividing I-beam 31a along the midpoint of the web (FIG. 21C). It will be understood from the balance of internal forces that the internal forces which generate the concave deformation (FIG. 21C) in the divided I-beams do not cause torsion in the final product but that the internal forces which generate the convex deformation (FIG. 19D) in the divided I-beams cause the torsion in the final product.

The dimensions of first and second pairs of rolls 2a and 2b and the dimensions of the corrugations of first and second corrugated webs 31a and 31b are determined as discussed above and by the following working conditions:

$$\frac{\epsilon_1}{\epsilon} = 0.2 \text{ to } 0.8 \quad (1)$$

$$\text{or } \frac{\epsilon_2}{\epsilon} = 0.8 \text{ to } 0.2; \text{ and}$$

(2) the convex portions of first corrugations 31a worked by first pair of rolls 2a are worked into concave portions of second corrugations 31b by second pair of rolls 2b (see FIGS. 20A and 20B).

The above working conditions can improve the residual stress conditions and reduce or eliminate the camber and torsion of the final product.

The strain relationships (1) set forth above can be determined as follows:

$$\underline{S_0 \rightarrow S_1} \quad (1)$$

$$\epsilon_1 = \frac{S_1 - S_0}{S_0}$$

$S_0$: rectilinear length of flat web of finished ordinary I-beam 1 (see FIG. 18A)

$S_1$: developed length of first corrugated web 31a of first I-beam 3a worked by first pair of rolls 2a (see FIG. 19A)

$\epsilon_1$: first strain in first corrugated web 31a when length $S_0$ is changed to length $S_1$ $$\underline{S_1 \rightarrow S_2} \quad (2)$$

$$\epsilon_2 = \frac{S_2 - S_1}{S_1}$$

$S_2$: developed length of second corrugated web 31b of second I-beam 3b worked by second pair of rolls 2b (see FIG. 21A)

$\epsilon_2$: second strain in second corrugated web 31b when length $S_1$ is changed to length $S_2$ $$\underline{S_0 \rightarrow S_2} \quad (3)$$

$$\epsilon = \frac{S_2 - S_0}{S_0}$$

$$= \frac{(S_2 - S_1) + (S_1 - S_0)}{} = \frac{S_2 - S_1}{S_0} + \frac{S_1 - S_0}{S_0}$$

$$= \frac{S_2 - S_1}{S_1} + \frac{S_1 - S_0}{S_0} \; (S_0 = S_1)$$

$$= \epsilon_1 + \epsilon_2$$

$\epsilon$=composite strain in second corrugated web 31b when length $S_0$ is changed to length $S_2$.

The dimensions for determining the form of corrugation by the method according to the present invention are preferably selected from the following ranges:

i. $9.3t < L < 36t$ ii. $1.0t < f < 3.9t$ iii. $0.5h < C < h - L$

Figure 4:
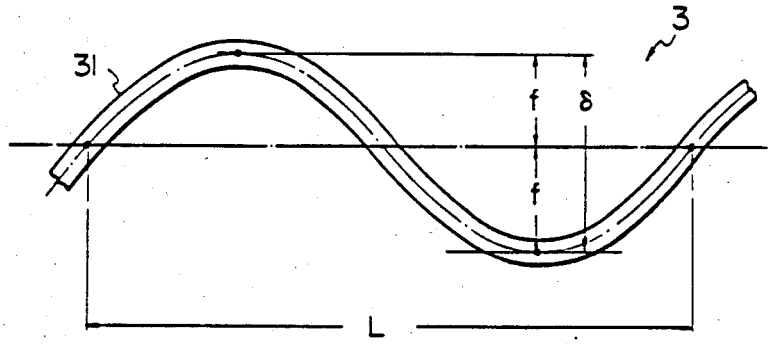
FIG. 4 is an enlarged fragmentary longitudinal sectional view of a corrugated portion in the central area of the web of the I-beam produced by the method according to the present invention.

The characters in these ranges denote dimensions of portions of the I-beam shown in FIGS. 2 and 4, as follows:

t: thickness of web h: height of web f: amplitude of corrugation

C: width of corrugation

L: pitch of corrugation

These ranges were set for the reasons described below.

(1) Possible Producing Range

Figure 2:
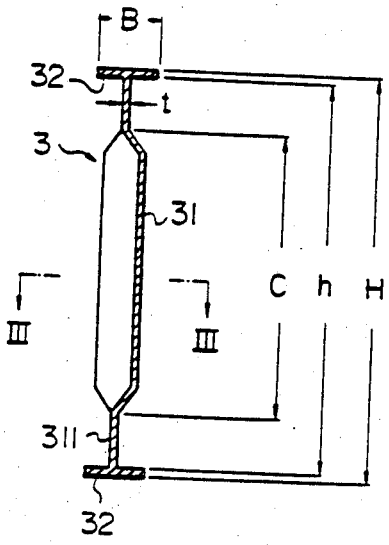
FIG. 2 is a cross-sectional view of an I-beam produced by the method according to the present invention.
Figure 3:
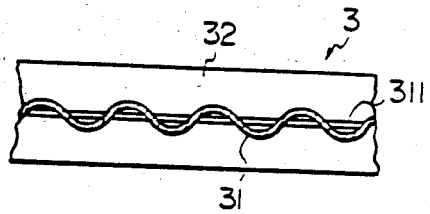
FIG. 3 is a longitudinal sectional view taken along the line III—III of FIG. 2.

Each corrugation is, as shown in FIGS. 2 and 3, formed at right angles to the axis of the beam. While the depressions and the peaks must be disposed alternatively to avoid eccentricity, they need not always be continuous but may include flat portions between the depressions and the peaks in the corrugation. The corrugation may be of a trapezoidal form instead of a wave form. In production, however, since the elongation rate of the web material during rolling for corrugation is preferably as small as possible and for a given elongation rate the number of the depressions and the peaks in a specific length is preferably as large as possible for better effect, the depressions and the peaks are preferably continuous. Repeated corrugating production tests show that the elongation rate of corrugation of 12% or less is a favorable range.

(2) Pitch (L) and Amplitude (f) of the Corrugations

An effect of the corrugation is to increase the flexural rigidity of the web in the direction at right angles to the axis of the beam. The increase in the flexural rigidity is effected most by the amplitude of corrugation f.

Figure 5:
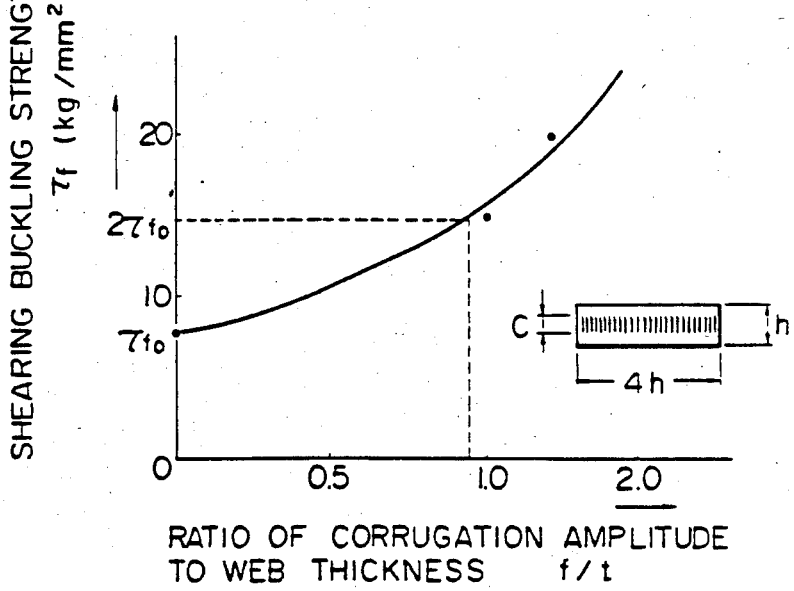
FIG. 5 is a graph showing the relation between the ratio of corrugation amplitude to web thickness and the shearing buckling strength.

FIG. 5 shows the relation between the ratio of corrugation amplitude to web thickness f/t and the shearing buckling strength $\tau f$. The shearing buckling strength $\tau$ is affected by the corrugation width C, and the web thickness t. The tests were made on I-beam having a shape to which the method according to the present invention is considered to be most generally applied, having the web thickness $t=h/120$, and a corrugation width $C=0.75h$. As seen from the curve of FIG. 5, the strength $\tau f$ increases parabolically as the corrugation amplitude f increases.

While the increase in the shearing strength due to the corrugation is obtained in spite of a reduction of the web thickness t, the cost for the corrugating is not recovered unless the effect achieved by corrugating is sufficient to reduce the web thickness by at least 25%. Since the shearing buckling strength of the flat web is proportional to $(t/h)^2$, a 25% reduction in the web thickness results in an approximately 50% reduction in strength. In order to compensate for the reduction in strength by the corrugation, accordingly, the corrugation amplitude must be determined, so that the strength of the corrugated web is two or more times the strength $\tau f_0$ of a flat web ($f=0$). Accordingly, the value of f is obtained as $f/t>1$ from FIG. 5.

Figure 6:
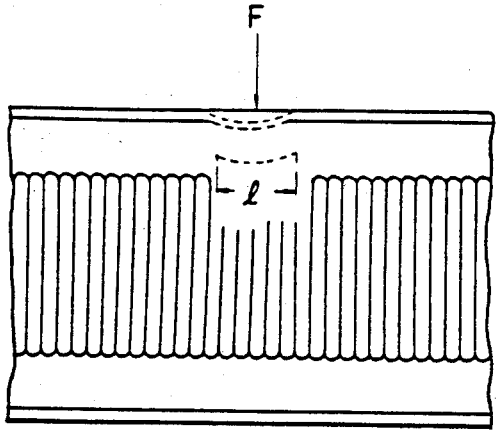
FIG. 6 is a schematic illustration of an experiment on buckling due to a laterally concentrated force.

The corrugation pitch L is preferably as small as possible for smaller turbulence of stress and for better stability with respect to a laterally concentrated force F. Experiments on the laterally concentrated force as shown in FIG. 6 showed that local buckling was caused in the web adjacent the point at which the force was applied and the length l of the buckling wave was approximately 0.4h. This strength is important in determining the shape of the web. In order to obtain this strength at any position, it is necessary to determine the corrugation pitch L such that the buckling wave length l includes at least two waves of the corrugation. This requires accordingly that the corrugation pitch L must be 0.2h or less.

On the other hand, the corrugation pitch L and the corrugation amplitude f are related to the elongation during production; that is, as the value L/f decreases the elongation due to the forming of the corrugations becomes larger. In order to limit the elongation rate to 12% or less as described hereinabove, the value L/f must be greater than 9.3 ($L/f>9.3$).

As described above, the shape of the corrugation is subject to three limitations to achieve the desired performance and workability. Further, assuming that the practical range of the web thickness is $h/100>t>h/180$, the range of the corrugation pitch L will be $h/20<L<h/5.0$ or $9.3t<L<36t$, and the range of the corrugation amplitude f is $h/180<f<h/46$ or $1.0t<f<3.9t$.

(3) Width of Corrugation (C)

Figure 7:
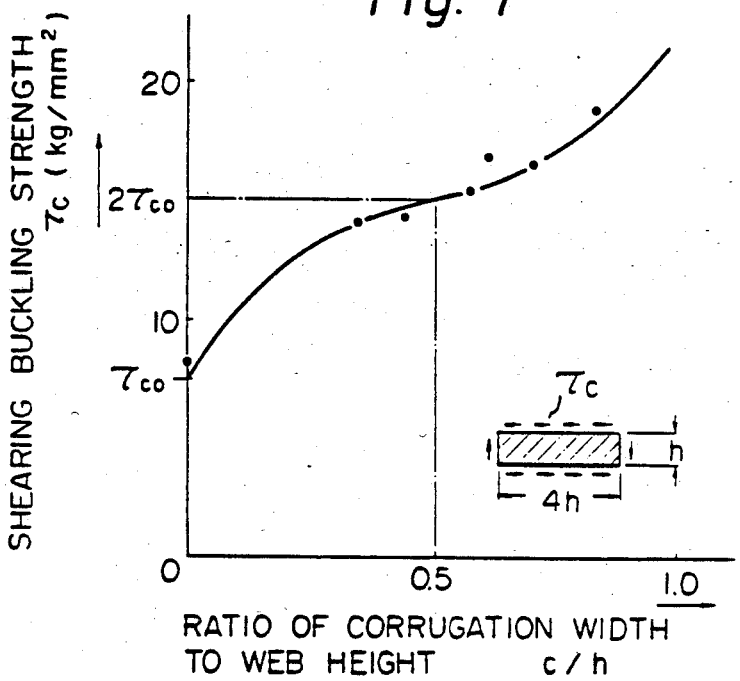
FIG. 7 is a graph showing the relation between the ratio of corrugation width to web height and shearing buckling strength.

The corrugation width C is closely related to the shearing buckling strength $\tau_C$ and the strength under a laterally concentrated load R applied to the web. FIG. 7 shows the relation between the ratio of the corrugation width to the web height (C/h) and the shearing buckling strength $\tau_C$ of the case, for example, where $h/t=120$ and $f/t=1.3$ in FIG. 7, black spots represent experimental values and the solid curve represents analytical values. As described hereinabove, the shearing buckling strength $\tau_C$ of the corrugated web is required to be two or more times the strength $\tau C_0$ of the flat web ($C=0$). Accordingly, the value of C/h providing the strength in this range is shown by FIG. 7 to be $C/h>0.5$.

Figure 8:
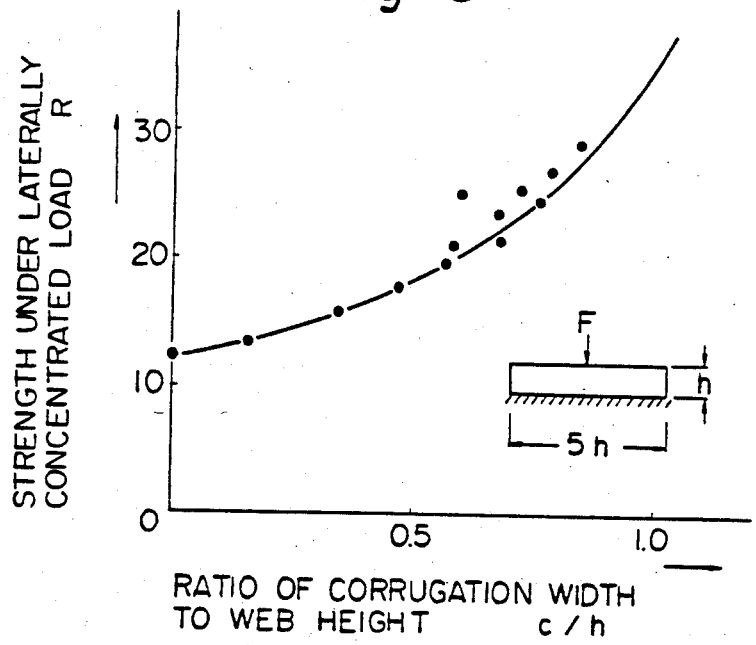
FIG. 8 is a graph showing the relation between the ratio of corrugation width to web height and the laterally concentrated load strength.

FIG. 8 shows the relation between the ratio of the corrugation width to the web height (C/h) and the strength under a laterally concentrated load R. It will be seen from FIG. 8 that the ratio C/h of 0.5 or greater provides a sufficient corrugation effect. Here, $R=Fh/\pi D$, where $$D = \frac{Et^3}{12(1-\gamma^2)},$$

E is the elastic modulus and $\gamma$ is Poisson's ratio. In FIG. 8, black spots represent experimental values and the solid curve represents the experimental equation $$R = \frac{1.86}{1.5 - C/h}.$$

Accordingly, the practically effective range for corrugating the central portion of the web for the purpose of increasing the shearing buckling strength $\tau_C$ and the strength under a lateral concentrated load R applied to the web is $C/h>0.5$. The upper limit of the value C/h is defined by the working limit and the turbulence of the stress caused in the flange. That is, if the corrugation width C is too great, damage is caused not only because the flange is waved during corrugation but also because a great stress is produced at the junction between the web and the flange. Trial production tests show that there is no problem if the width of the uncorrugated portion is 6t or greater or 0.5L or greater. The experiments further confirm that turbulence of stress in the flange portion by the corrugation has no effect if the width of the uncorrugated portion is 0.5L or more.

Accordingly, the effective range of the corrugation width is defined as 0.5h or greater, $(h-L)$ or less and $(h-12t)$ or less.

Figure 9:
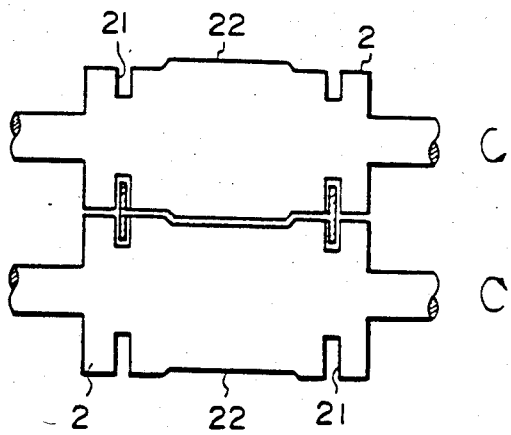
FIG. 9 is a vertical sectional view of corrugating and producing rolls according to the present invention.
Figure 10:
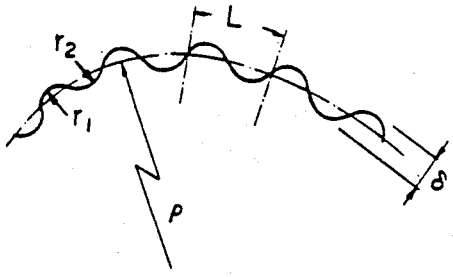
FIG. 10 is an enlarged fragmentary sectional view of the body of the roll of FIG. 9.

The producing rolls 2*a* and 2*b* for use in the method according to the present invention have the shape shown in FIGS. 9 and 10. As shown in FIG. 9, each of a pair of producing rolls 2 is provided on the working surface thereof with grooves 21 spaced from each other a distance corresponding to the uncorrugated height of the web h (see FIG. 2) of the I-beam 1 for guiding the flanges of the I-beam 1, and further with a corrugated zone 22 having a corrugation width C (see FIG. 2) between said grooves 21.

The corrugated zone 22, as shown in FIG. 10, has a shape defined by a pitch radius P, radii of waveform curvature $r_1$ and $r_2$, a corrugation pitch L, a wave depth $\delta$, and a corrugation width C. The relations among these dimensions are determined in accordance with the dimension of the I-beam in such a way that no change is caused in the major sectional dimension thereof except in the corrugated area of the I-beam.

In this embodiment, each of the producing rolls is provided on the roll surface thereof with pair of grooves 21 for guiding the flanges 32 of the I-beam 1 to be corrugated. Accordingly, the rolls of this embodiment have a disadvantage that the I-beam to be corrugated must have a width of the web 31 corresponding to the distance between the grooves 21, so that the rolls lack versatility. Particularly in cold forming in which the rolls should be made of high alloy steel having a high hardness, the rolls of this embodiment present a further problem in that it is extremely difficult to form narrow and deep guiding grooves therein.

These problems are solved by the rolls of various other embodiments as will be described hereinafter with reference to FIGS. 11 to 17.

Figure 11:
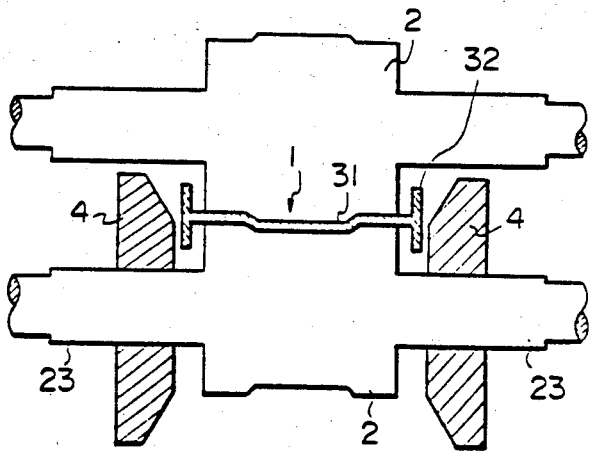
FIG. 11 is a sectional front view of the rolls used in the production line of FIG. 1.

In the embodiment shown in FIG. 11, in a pair of corrugating rolls 2, the roll bodies have a width corresponding to the web height h of the I-beam, that is, somewhat smaller than the web height h so that the flanges 32 of the I-beam are clear of the surface of engagement between the rolls 2. Further, one of the upper and the lower rolls is provided with flange guides 4. For example, in the case where the flange guides 4 are provided on the lower roll 2 as shown in FIG. 11, the flange guides 4 are fitted on the journal 23 at both the ends of the body of the lower roll 2, the axial positions are adjusted and then the flange guides 4 are fixed on the journal 23 at positions corresponding to the positions of the flanges 32 of the I-beam 1.

Figure 12:
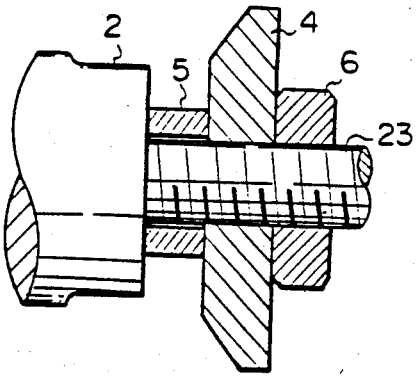
FIG. 12 is a partial sectional view of an embodiment of the roll used in the present invention.

Various type of means can be used to fix the flange guides 4. For example, as shown in FIG. 12, the journal 23 of the roll 2 may be threaded, and a collar 5 is interposed between the body of the roll 2 and the flange guide 4, whereby the flange guide 4 is held in position and securely clamped by a nut 6 from the outside.

Figure 13:
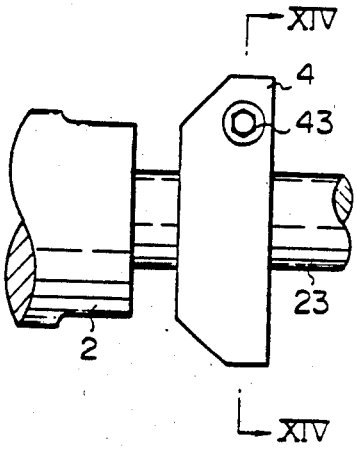
FIG. 13 is a partial elevational view of another embodiment of the roll used in the present invention.
Figure 14:
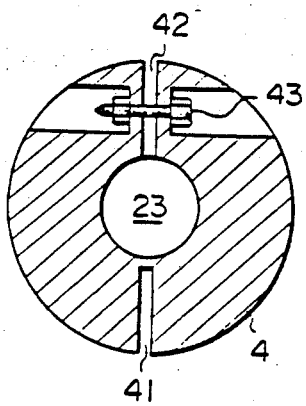
FIG. 14 is a cross-sectional view of the flange guide taken along the line XIV—XIV of FIG. 13.

As shown in FIGS. 13 and 14, the flange guide 4 may be provided with a radial split groove 41 and another split groove 42 extending to the central bore on the side opposite to the split groove 41, so that the flange guide 4 can be slidably moved along the journal 23 utilizing the expansion and contraction made possible by these split grooves to the selected position at which the split groove 42 is closed by suitable clamping means 43 such as a bolt to constrict the central bore of the guide 4 to thereby fix it to the journal.

Figure 15:
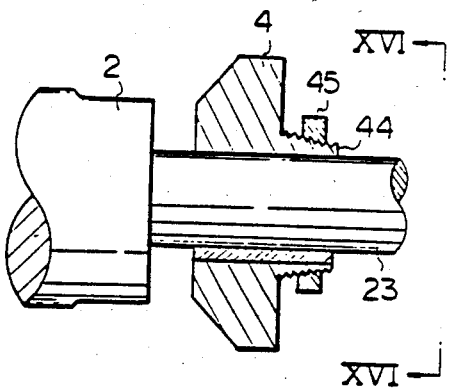
FIG. 15 is a partial sectional view of a further embodiment of the roll used in the present invention.
Figure 16:
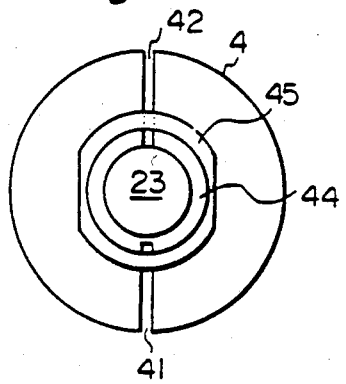
FIG. 16 is a front view of the flange guide seen from the line XVI—XVI of FIG. 15.

As shown in FIGS. 15 and 16, the flange guide 4 may be provided with diametrically extending split grooves 41 and 42, and a tapered threadably engaging portion 44 on which a lock nut 45 is threadably engaged so as to constrict the central bore of the flange guide 4 to thereby fix it to the journal.

Figure 17:
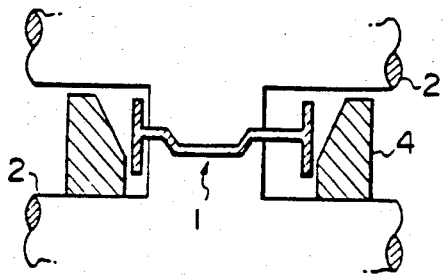
FIG. 17 is a partial sectional front view of the rolls used in the present invention showing another mode of use thereof in the production line.

By these various types of fixing means the flange guides 4 are fixed on the journals 23 of the roll 2 to guide the flanges 32 of the I-beam 1 from the outside. Since the flange guides 4 can be positioned as desired on the journal 23 of the roll, the fixing positions of the flange guides are not regulated by the web height h of the I-beam 1. Since it is not necessary that the flange guides 4 be fixed at bisymmetrical positions, it is possible to corrugate the web along an out-of-central line as shown in FIG. 17. Such an eccentric corrugation can be effective under certain circumstances dependent upon, for example, the condition of the load applied during the use of the I-beam and the relation of the beam with other members to which it is joined.

The corrugation rolls of these embodiments have advantages such that they are widely applicable to, for example, eccentric corrugation without being limited by the web height of the I-beam, and that they have an excellent guiding effect such as more stabilized centering during corrugating since they can establish a longer effective guide distance than in conventional rolls. Moreover, these rolls are easier to manufacture.

Specific examples of the practice of the method according to the present invention will now be shown in Table 1.

TABLE 1

| Size of Beam H × B × t' × t'' | | | | 203.2 × 68.3 × 2.0 × 4.7 | 256.5 × 87.4 × 2.3 × 4.7 | 307.3 × 87.4 × 2.3 × 6.0 |
|---|---|---|---|---|---|---|
| Corrugating Condition | | Working speed | m/min | 24 | 24 | 24 |
| | | Roll Opening | mm | 0.8 | 1.4 | 1.4 |
| | | Rolling Load | Ton | 60–70 | 130–140 | ~ |
| | | Rolling Torque | Ton/M | 0.5–0.6 | 1.0–1.2 | ~ |
| Results | One-Pass Corrugating | Corrugation Width C | mm | 100 | 150 | 200 |
| | | Corrugation Thickness t | " | 1.85 | 2.05 | 2.05 |
| | | Corrugation Pitch L | " | 30.8 | 31.0 | 31.0 |
| | | Corrugation Depth δ | " | 5 | 6 | 6 |
| | | Torsion | — | None (Torsion observed when cut short). | | |
| | Two-Pass Corrugating | Corrugation Width C | mm | 100 | 150 | 200 |
| | | Corrugation Thickness t | " | 1.80 | 2.00 | 2.00 |
| | | Corrugation Pitch L | " | 30.0 | 30.0 | 30.0 |
| | | Corrugation Depth δ | " | 6 | 7 | 7 |
| | | Torsion | — | None (Not observed even when cut short). | | |

(t': web thickness of the beam,
t'': flange thickness of the beam)

As seen from Table 1, I-beams having the desired corrugated webs were obtained by examples of the practice of the method according to the present invention. The developed length of the curve of the corrugated zone is longer than the entire rectilinear length of the web material and the increase in the developed length corresponds with the reduction in thickness of the web.

When a short I-beam of the order on 1.5 meters or so in length is corrugated by a single pass, a torsion is caused therein, which is, however, eliminated by a second pass corrugating. In a long I-beam of 6 meters or greater in overall length, no torsion is caused by a single pass. When cut into short lengths, however, the internal stress is released and torsion can appear. In an I-beam worked by two or more passes of corrugating, no torsion appears even when the beam is cut into short lengths.

Figure 22:
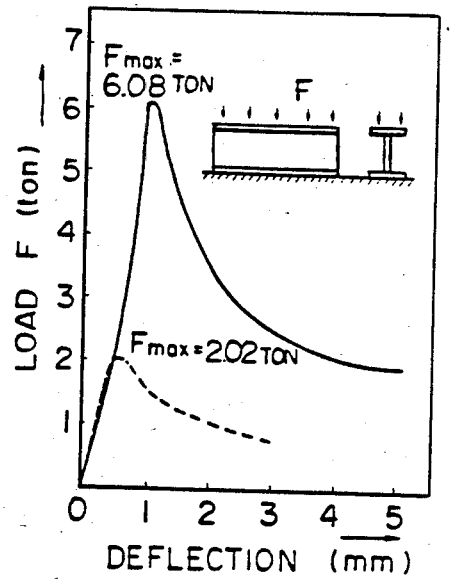
FIG. 22 is a graph showing the load-deflection curve for the lateral compression test.
Figure 23:
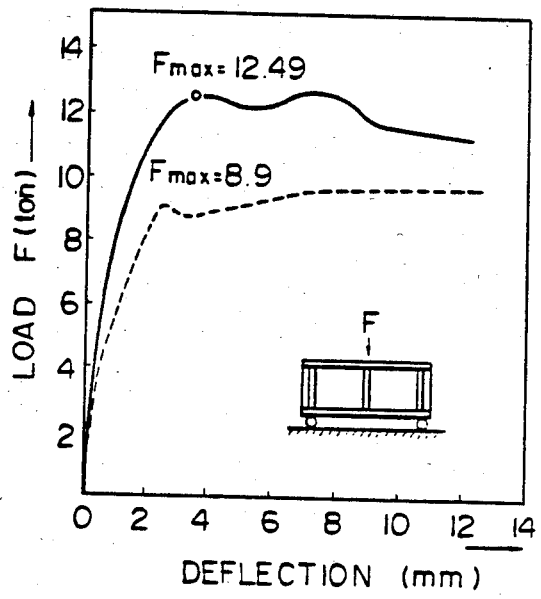
FIG. 23 is a graph showing the load-deflection curve for shearing buckling test.

FIGS. 22 and 23 show the results of lateral compression tests and shearing buckling tests, respectively, on an I-beam having a corrugated web and an ordinary I-beam having a flat web. In FIGS. 22 and 23, the solid lines represent the experimental results of tests on the I-beam having the corrugated web and the broken lines represent the experimental results of the tests on the ordinary I-beam. The size of the materials tested was 212×68.6×2.0×4.6. In the experiments, a 100 ton testing machine was used and the deflection was measured by two dial gauges.

As seen from these experimental results, the strength under the lateral compression of the I-beam having corrugated web is approximately three times as great as that of the ordinary I-beam. The shearing buckling strength of the I-beam having the corrugated web is approximately 1.4 times as great as that of the ordinary I-beam.

Table 2 shows the size of the conventional welded lightweight ordinary I-beams and the size of the I-beams having a corrugated web produced by the method according to the present invention. The conventional I-beams shown in Table 2 were chosen from those having a shearing buckling stress greater than the yielding strength. The I-beams having the corrugated web were identical to the conventional I-beams in beams height H and in flange size δ (see FIG. 2) and smaller only in the web thickness t. If the web thickness is reduced without corrugating it, the shearing buckling strength is reduced to approximately 30% of the yielding strength. In the I-beams with the corrugated web, however, the shearing buckling strength of the web is maintained above the yielding strength by the corrugating effect.

In Table 2, the corrugated zone is excluded in the calculation of the bending performance since the corrugated zone is considerably reduced in axial rigidity. As seen from Table 2, the ratio of flexural rigidity per unit weight can be increased 9% to 13% by corrugating the web.

TABLE 2

| Conventional Method | Present Invention | Comparison |
|---|---|---|
| (I) JISG 3353 Material | (II) Corrugated Web Material (Corrugation width) | Ratio of Bending Performance per Weight (II/I)* |
| 200 × 100 × 3.2 × 4.5 | 200 × 100 × 1.6 × 4.5 (150) | 1.09 |
| 250 × 125 × 4.5 × 6.0 | 250 × 125 × 2.0 × 6.0 (180) | 1.13 |

TABLE 2-continued

| Conventional Method | Present Invention | Comparison |
|---|---|---|
| 300 × 150 × 4.5 × 6.0 | 300 × 150 × 2.3 × 6.0 (220) | 1.10 |
| 400 × 200 × 6.0 × 12.0 | 400 × 150 × 2.7 × 12.0 (300) | 1.09 |

*Ratio of Bending Performance per Weight =

$$\frac{\text{Weight of Conventional I-beam}}{\text{Weight of Corrugated I-beam}} \cdot \frac{\text{Flexural Rigidity of Corrugated I-beam}}{\text{Flexural Rigidity of Conventional I-beam}}$$

While we have shown and described specific embodiments of our invention, it will be understood that these embodiments are merely for the purpose of illustration and description and that various other forms may be devised within the scope of our invention, as defined in the appended claims.

What is claimed is:

1. A method for producing an I-beam having a centrally corrugated web, comprising the steps of:

corrugating a central portion of the web of a finished ordinary I-beam by passing between first and second pairs of complementary intermeshing corrugating rolls of the same dimension in a single pass a finished ordinary I-beam having an uncorrugated web with a thickness t and a web height h for producing in said web by the action of said corrugating rolls thereon corrugations having a width C and an amplitude f and said corrugations being at a pitch L, in the following relationships:

$9.3t<L<36t$ $1.0t<f<3.9t$ $0.5h<C<h-L$, said amplitude f being uniform from substantially one side of said width C to the other;

reducing the thickness of the web by the action of said intermeshing corrugating rolls for increasing the developed lengths $S_1$ and $S_2$ of the web portions corrugated by said first and second pairs of rolls as compared to the rectilinear length $S_0$ of the flat web before corrugation, respectively, while making no other change in the major dimensions of the I-beam, in the following relationships:

$$\epsilon_1 = \frac{S_1 - S_0}{S_0}$$

$$\epsilon_2 = \frac{S_2 - S_1}{S_1}$$

$$\epsilon = \frac{S_2 - S_0}{S_0}$$

$$\epsilon = \epsilon_1 + \epsilon_2$$

$$\frac{\epsilon_1}{\epsilon} = 0.2 \text{ to } 0.8; \text{ and}$$

forming the convex portions of the corrugations worked by said first pair of rolls into the concave portions of the corrugations by said second pair of rolls for improving the residual stress conditions and reducing or eliminating cambering and torsion of the thus corrugated beam.

* * * * *